US006663183B1

(12) United States Patent
Liao

(10) Patent No.: US 6,663,183 B1
(45) Date of Patent: Dec. 16, 2003

(54) CONTROLLING DEVICE FOR A BODY SUPPORT PIVOTALLY MOUNTED ON TOP OF A STOOL

(76) Inventor: Simon Liao, 6F-3, No. 27, Lane 61, Sec. 1, Kuang-Fu Rd., Sanchung City, Taipei Hsien (TW)

( * ) Notice: Subject to any disclaimer, the term of this patent is extended or adjusted under 35 U.S.C. 154(b) by 0 days.

(21) Appl. No.: 10/208,048

(22) Filed: Jul. 31, 2002

(51) Int. Cl.[7] ..... A47C 7/54
(52) U.S. Cl. ..... 297/411.35; 74/575
(58) Field of Search ..... 297/411.35; 74/575, 74/576, 577 R, 577 S, 577 SF, 577 M, 578; 248/292.18; 192/43.1

(56) References Cited

U.S. PATENT DOCUMENTS

| | | | | | |
|---|---|---|---|---|---|
| 292,666 | A | * | 1/1884 | Mansfield | 192/43.1 |
| 294,282 | A | * | 2/1884 | Sinclair | 408/122 |
| 295,797 | A | * | 3/1884 | Osborn | 192/43.1 |
| 455,133 | A | * | 6/1891 | Thring | 192/43.1 |
| 470,954 | A | * | 3/1892 | Sinclair | 81/62 |
| 2,107,568 | A | * | 2/1938 | Haist | 192/43.1 |
| 2,867,144 | A | * | 1/1959 | Stevens | 81/470 |
| 3,138,030 | A | * | 6/1964 | Godel | 74/159 |
| 3,468,176 | A | * | 9/1969 | Boucherie | 74/142 |
| 3,626,452 | A | * | 12/1971 | Winter et al. | 74/143 |
| 4,112,278 | A | * | 9/1978 | Greiner et al. | 74/143 |
| 4,336,728 | A | * | 6/1982 | Deibert | 81/62 |
| 5,613,585 | A | * | 3/1997 | Tiede | 192/43.1 |
| 5,624,154 | A | * | 4/1997 | Kishi | 297/217.1 |
| 5,887,948 | A | * | 3/1999 | Hannes | 297/411.35 |

* cited by examiner

*Primary Examiner*—Peter R. Brown
*Assistant Examiner*—Stephen D'Adamo
(74) *Attorney, Agent, or Firm*—Varndell & Varndell, PLLC

(57) ABSTRACT

A controlling device for a support pivotally mounted on top of a stool includes a housing adapted to securely engage with a bottom face of the support, two pawls pivotally received in the housing, a wedge and control knob connected to the wedge and a ratchet gear received in the housing. After either one of the pawls is activated, the activated pawl is able to selectively engage with the ratchet gear so that the support is able to pivot in a predetermined direction.

7 Claims, 6 Drawing Sheets

CONTROLLING DEVICE FOR A BODY SUPPORT PIVOTALLY MOUNTED ON TOP OF A STOOL

BACKGROUND OF THE INVENTION

1. Field of the Invention

The present invention relates to a controlling device, and more particularly to a controlling device for a body support pivotally mounted on top of a stool. The controlling device includes a ratchet gear and two pawls respectively and selectively engaged with one tooth of the ratchet gear so as to control pivotal direction of the body support.

2. Description of Related Art

Professionals such as medical personnel and dentists often require a specialized seating so that when the occupant is seated on the specialized seating, a portion other than the buttocks of the occupant's body is also supported. Because these specialized people often need to bend their bodies to perform a certain procedure on the patient, the bending portion of the user's body will gradually deform and thus the user will experience an occupational hazard if the bending body portion is not supported. For example, the dentist often leans forward to the patient to perform medical treatment on the patient lying on the couch or chair. After a long period of time without any support to the back, the dentist will be troubled by back disorders. To solve the problem, a chair with a support is introduced to the market so that the user is able to have support either to the abdomen or the back of the user's body. However, the support on the chair is fixed so that the entry and exit of the chair is difficult for the user. Again, to obviate the drawback, an invention is introduced to the market. The invention was issued patent on Mar. 30, 1999 to Joseph Hannes, Franklin bearing the Ser. No. 5,887,948.

Referring to FIGS. 6, 7 and 8 of the patent, it is noted that the ratchet mechanism of the invention includes a casing (70) defining therein a space (80), a pawl (170) pivotally received in the casing (70) and a ratchet gear (90) securely attached to a distal end of a shaft (50) and having multiple ratchet teeth (96) thereon. After the assembly of the invention, the user is able to control the pivotal direction of the support 36 (as shown in FIG. 1) by engaging the distal end (174) of the pawl (170) with one tooth of the ratchet mechanism (90). When the distal end of the pawl (170) engages with one tooth of the ratchet mechanism (90), it is clearly seen from FIG. 8 that the support (36) can only be pivoted counterclockwisely. When the support (36) is to be pivoted clockwisely, due to the secure engagement of the distal end (174) of the pawl (170) to the ratchet mechanism (90), the support (36) is firmly fixed and can not be pivoted clockwisely. However, when the user releases the engagement between the distal end (174) of the pawl (170) and the ratchet mechanism (90), the support (36) is able to be freely rotated relative to the seat (32) (as shown in FIG. 1).

This kind of support member mounted on a seat does solve most of the problems for the specialized personnel. However, because the support can only pivot in one fixed direction, it is still inconvenient for the user. When the dentist, for example, is attending a patient lying on the bed on one side of the dentist, this conventional support member is able to provide sufficient support to either the abdomen or the back of the dentist. When the dentist must alternately attend two patients lying on two opposite sides of the dentist, the support member hinders the movement of the dentist. That is, the dentist will have to release the lock of the pawl

(170) to the ratchet gear (90) to freely rotate the support (36) and when the support (36) is re-positioned at an appropriate position, the user will then have to engage the pawl (170) to the ratchet gear (90) so as to lock the position of the support (36) relative to the seat (32). Then, the user will have to alternately adjust and readjust the support (36) relative to the seat (32), which is too troublesome and too time consuming.

To overcome the shortcomings, the present invention tends to provide an improved controlling device to mitigate and obviate the aforementioned problems.

SUMMARY OF THE INVENTION

The primary objective of the present invention is to provide an improved controlling device for a body support pivotally mounted on top of a stool. With the controlling device, the controlling device enables the user to move only a knob so as to control the pivotal direction of the body support.

Another objective of the present invention is to provide a ratchet gear and two pawls selectively engaged with one tooth of the ratchet gear so as to control the pivotal direction of the body support.

Still, another objective of the present invention is that means, such as a wedge, for alternatively activating either one of the pawls is provided in the controlling device so that the user is able to use the controlling device to change the pivotal direction of the support.

In order to accomplish the foregoing objective, the controlling device for a support pivotally mounted on top of a stool includes a housing adapted to securely engage with a bottom face of the support;

two pawls pivotally received in the housing;

means for activating movement of either one of the pawls; and a ratchet gear received in the housing, whereby after either one of the pawls is activated, the activated pawl is able to selectively engage with the ratchet gear so that the support is able to pivot in a predetermined direction.

An advantageous feature of the present invention is that the housing is composed of a top cover, a body and a bottom cover.

An advantageous feature of the present invention is that the bottom cover has two protruding posts respectively mounted on opposite sides of the bottom cover to correspond to the two pawls and two positioning rods each being formed close to a corresponding one of the protruding posts.

An advantageous feature of the present invention is that each pawl has a first end, a hole and a spring having a first end securely connected to the first end of the pawl and a second end securely connected to a corresponding one of the positioning rods so as to provide a recovery force to the corresponding pawl after a corresponding one of the protruding posts extends into the hole of the pawl.

An advantageous feature of the present invention is that the activating means comprises a wedge pivotally received in the housing to control the movement of the pawls.

An advantageous feature of the present invention is that the activating means further comprises a control knob pivotally mounted on the housing and opposite to the wedge.

An advantageous feature of the present invention is that the ratchet gear is formed on top of an extension which is adapted to be received the tube and has an indentation longitudinally defined in a periphery of the extension to receive therein a rectangular head, the rectangular head is formed with a threaded bolt which is extendable into the tube so that the rectangular head is received in the indentation and thus the extension is able to be adjustably moved relative to the tube.

Other objects, advantages and novel features of the invention will become more apparent from the following detailed description when taken in conjunction with the accompanying drawings.

DETAILED DESCRIPTION OF THE PREFERRED EMBODIMENT

Figure 1:
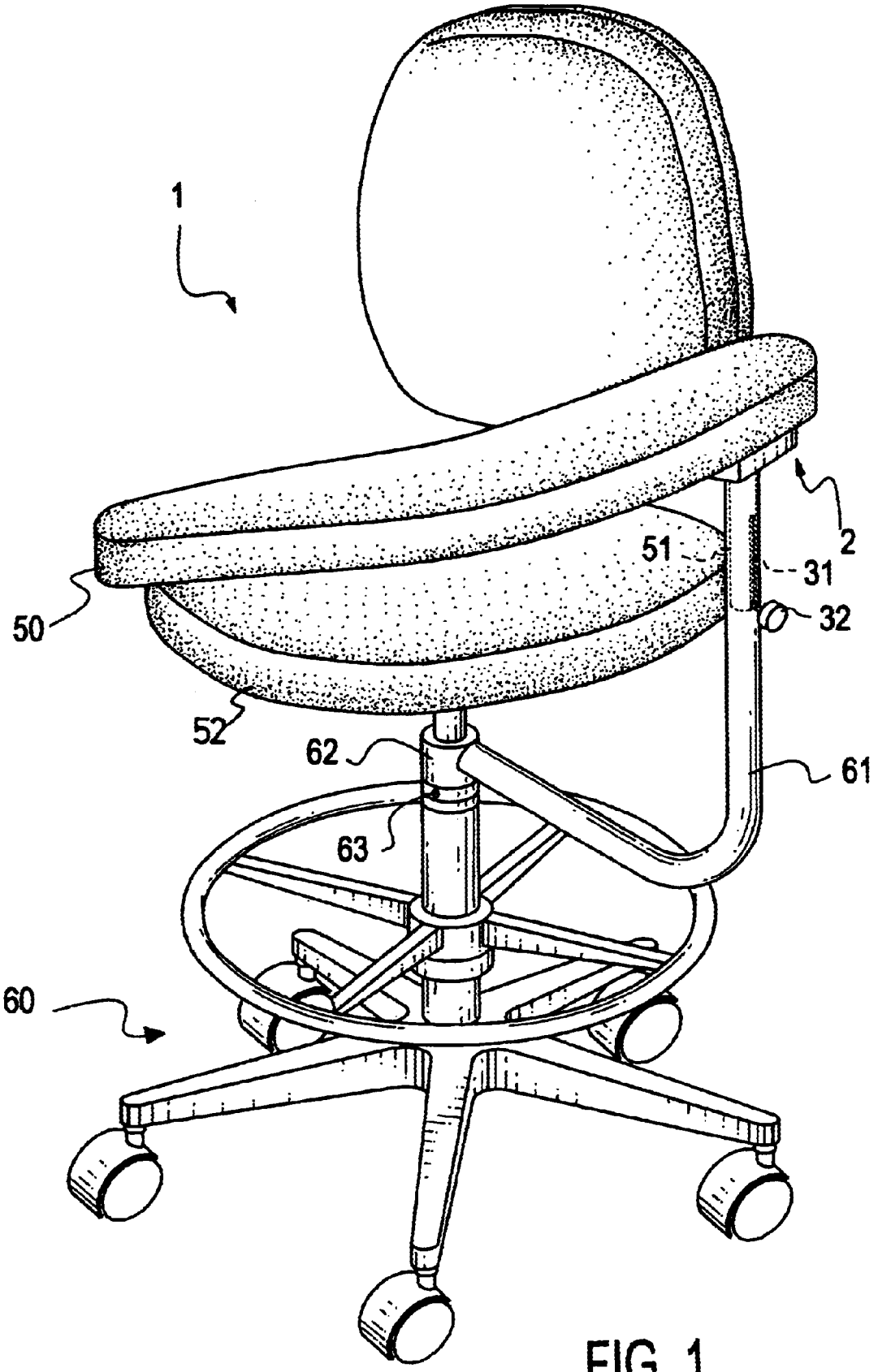
FIG. 1 is a perspective view of a stool adapted to have the controlling device of the present invention.
Figure 2:
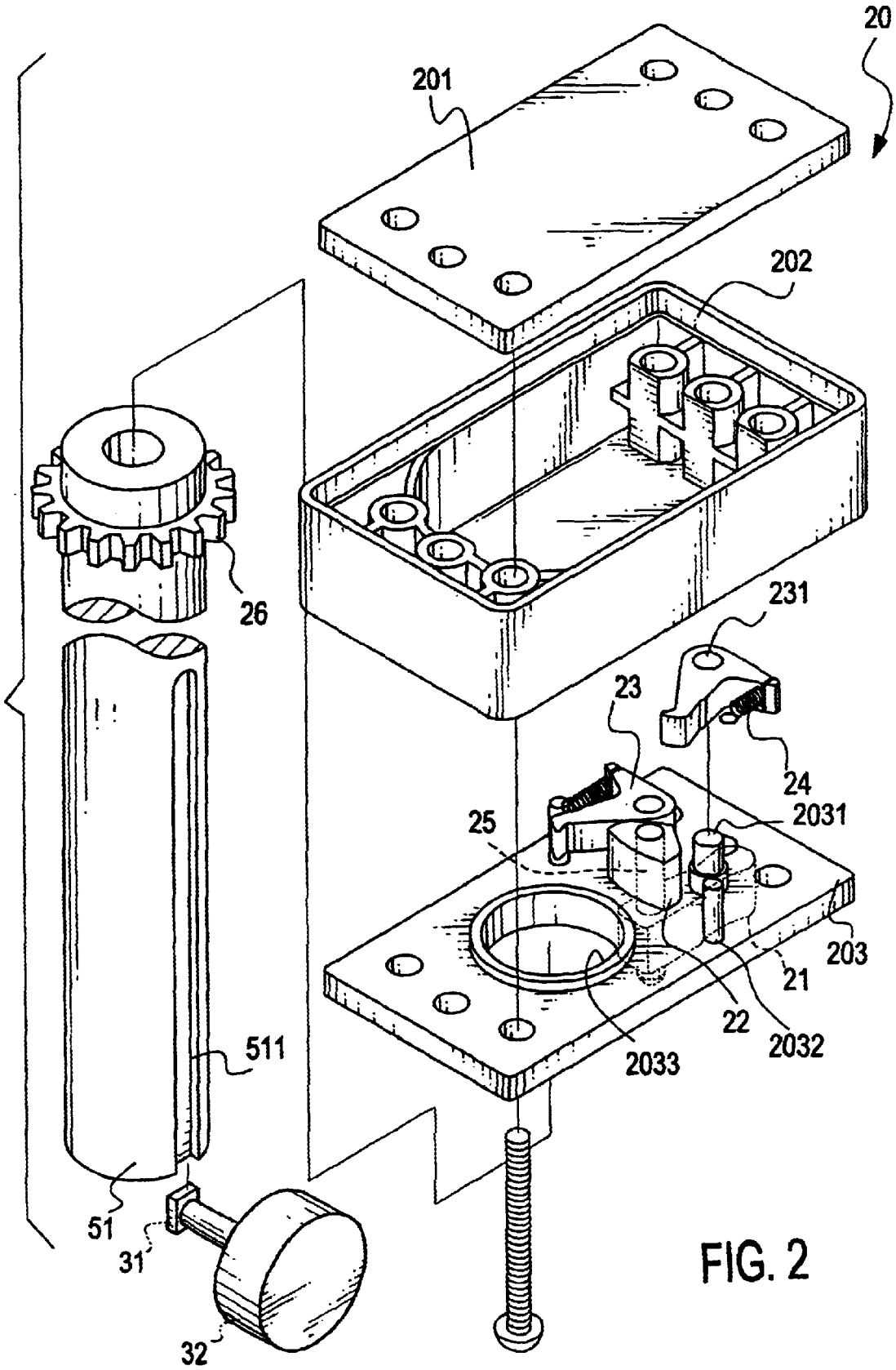
FIG. 2 is a schematic view showing the engagement between the seat and the stool base.

With reference to FIG. 1, a stool (1) for medical use has a base (60) and a support (50). The base (60) has a tube (61) extending upward to engage with the support (50), and a tubular connector (62) formed on the base (60) to rotatably connect to a bottom of a seat (52) by a rivet (63), as shown in FIG. 2.

Figure 3:
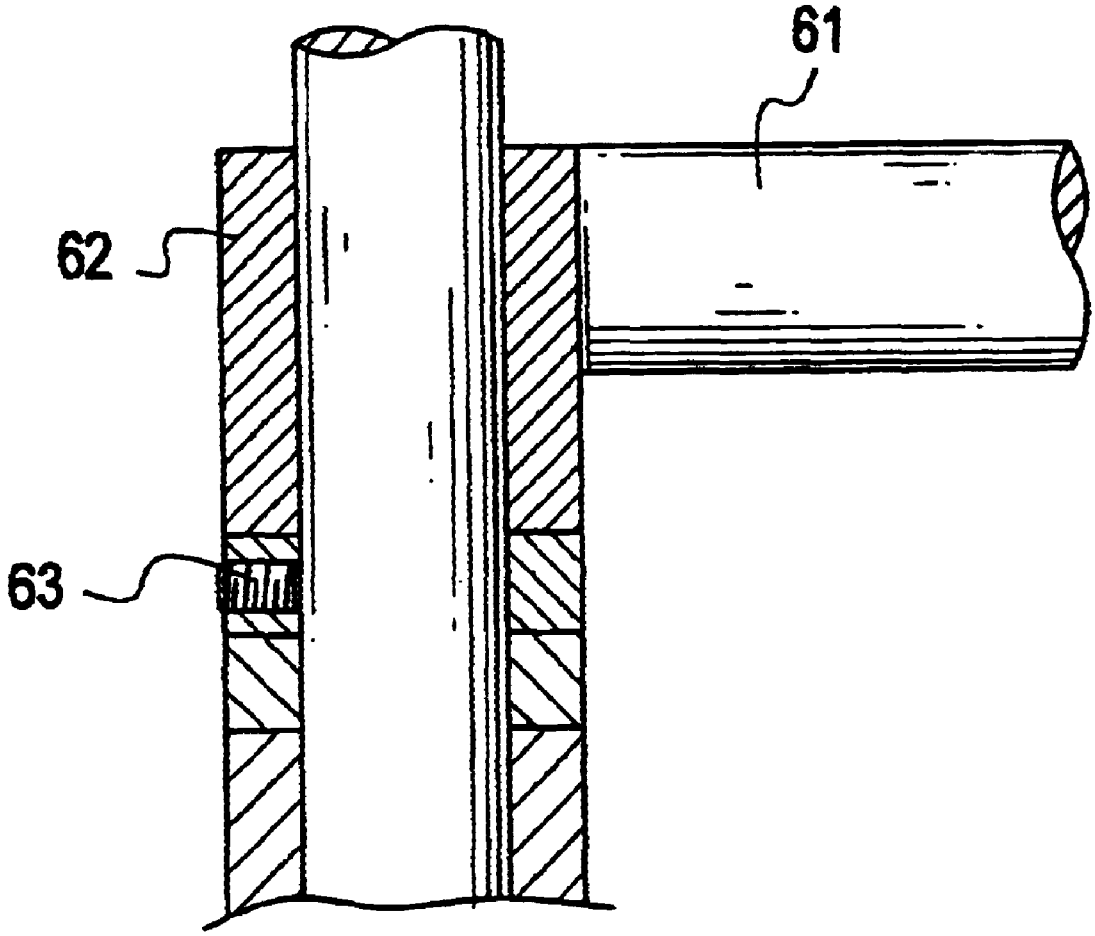
FIG. 3 is an exploded perspective view of the controlling device of the present invention.

With reference to FIG. 3 and still using FIG. 1 as a reference, the support (50) has an extension (51) received therein and extending downward to be received in the tube (61) of the base (60) and having an indentation (511) longitudinally defined in a periphery of the extension (51). A threaded bolt (32) extendable into the tube (61) has a rectangular head (31) so configured to be received in the indentation (511) whereby after the rectangular head (31) is received in the indentation (511), there is no relative rotation between the extension (51).and the tube (61). A controlling device (2) is mounted under a bottom face of the support (50) and has a housing (20) composed of a top cover (201), a body (202) and a bottom cover (203), a control knob (21), a wedge (22), two pawls (23) and a ratchet gear (26) which is securely formed on top of the extension (51) and having multiple teeth thereon. The bottom cover (203) has two protruding rods (2031) respectively formed on opposite sides of the bottom cover (203), two positioning rods (2032) each being adjacent to one of the two protruding rods (2031) and a through hole (2033) corresponding to the ratchet gear (26). Each pawl (23) has a hole (231) defined to correspond to one of the protruding rods (2031) and a spring (24) having a first end securely engaged with one end of the pawl (23) and a second end securely engaged with a corresponding one of the positioning rods (2032). The control knob (21) and the wedge (22) are separated by the bottom cover (203) yet connected to each other by a linking rod (25). The wedge (22) is positioned between the two protruding rods (2031).

When the controlling device of the present invention is to be assembled, preferably, the pawl (23) is mounted on the bottom cover (203) by inserting the protruding rod (2031) into the corresponding one of the holes (231) of the pawls (23). After the pawls (23) are mounted on the bottom cover (20), the second ends of the springs (24) are securely connected to the corresponding positioning rods (2032) so that each one of the springs (24) is able to provide recovery force to the corresponding pawl (23). Thereafter, the wedge (22) is mounted between the two pawls (23) and then the ratchet gear (26) is inserted into the housing (20) from the through hole (2033).

Figure 4:
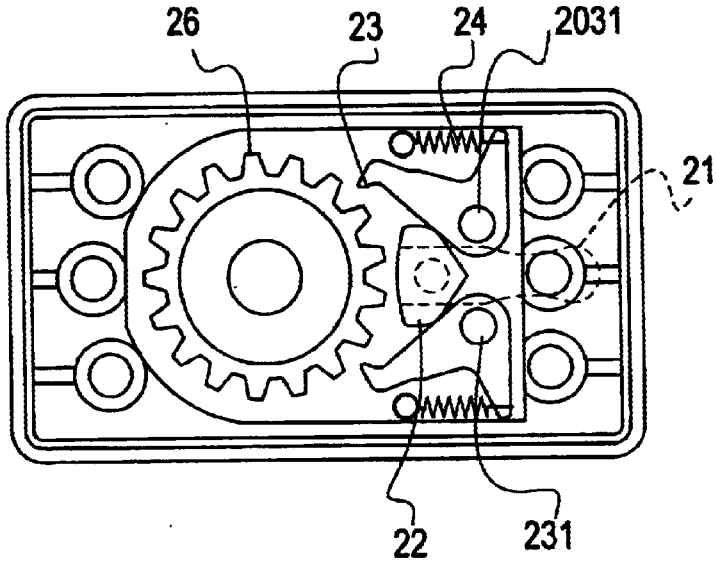
FIG. 4 is a is a top plan view showing the inner structure of the controlling device when assembled.
Figure 5:
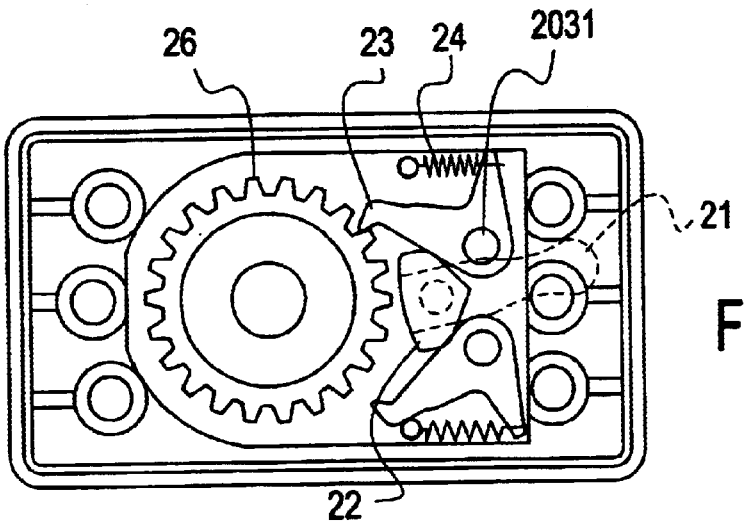
FIGS. 5 and 6 are top plan views showing either one of the pawls engages with the ratchet gear leads to different result.
Figure 6:
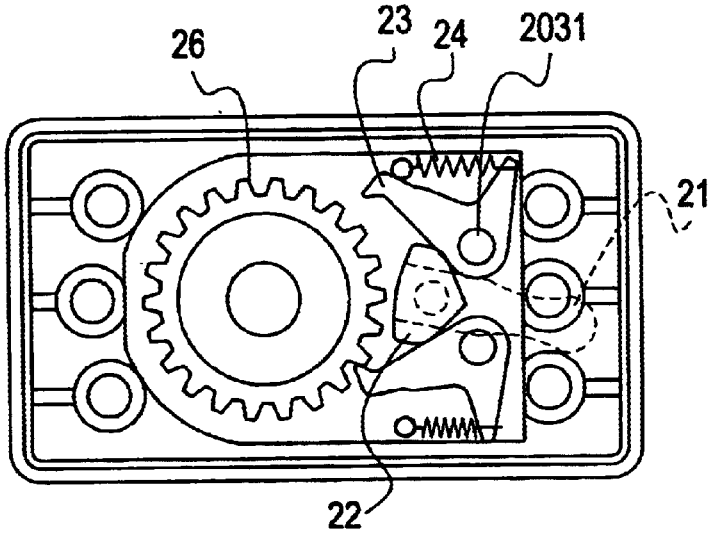

With reference to FIGS. 4, 5, and 6, after the foregoing assembly is finished, the user pivots the control knob (21) to move the wedge (22) so that one of the pawls (23) is pushed further away from the ratchet gear (26) and the other one of the pawls (23) is released to move further closer to the ratchet gear (26) so as to engage with the ratchet gear (26). It is noted that when either one of the pawls (23) is engaged with the ratchet gear (26), the support (50) can only be pivoted to a specific direction. That is, the user is able to use the control knob (21) to control the pivotal direction of the support (50) relative to the seat (52). Therefore, by simply a touch to the control knob (21), the pivotal direction of the support (50) is completely changed to an opposite direction, which is very convenient to the user. The user will no longer experience entrance and exit difficulties as the conventional stool does. In other words, the user may just pivot the control knob (21) to move the wedge (22) so as to pivot the support (50) to a required position to support either the back or the abdomen.

Figure 7:
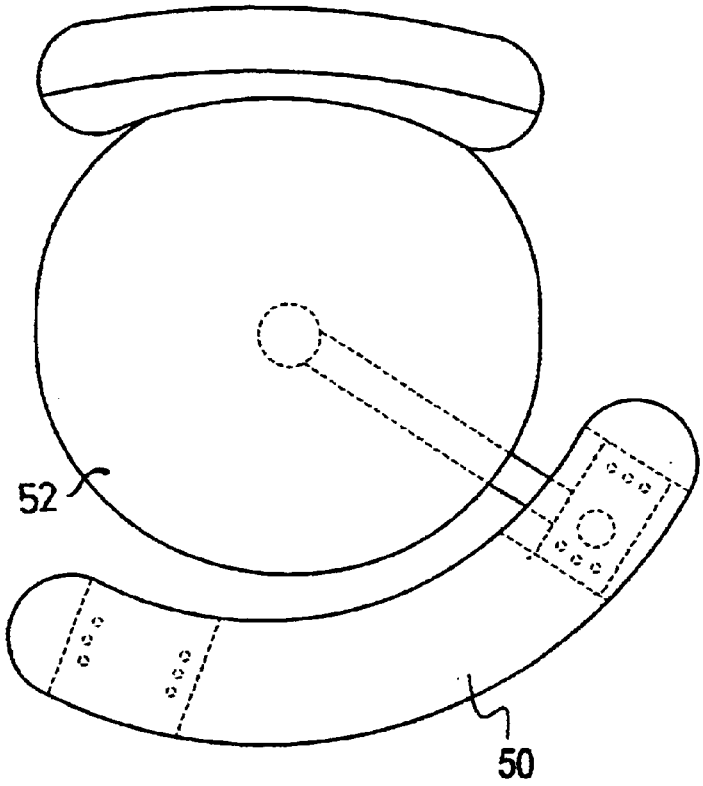
FIGS. 7 and 8 are schematic views showing the pivotal movement of the support relative to the seat.
Figure 8:
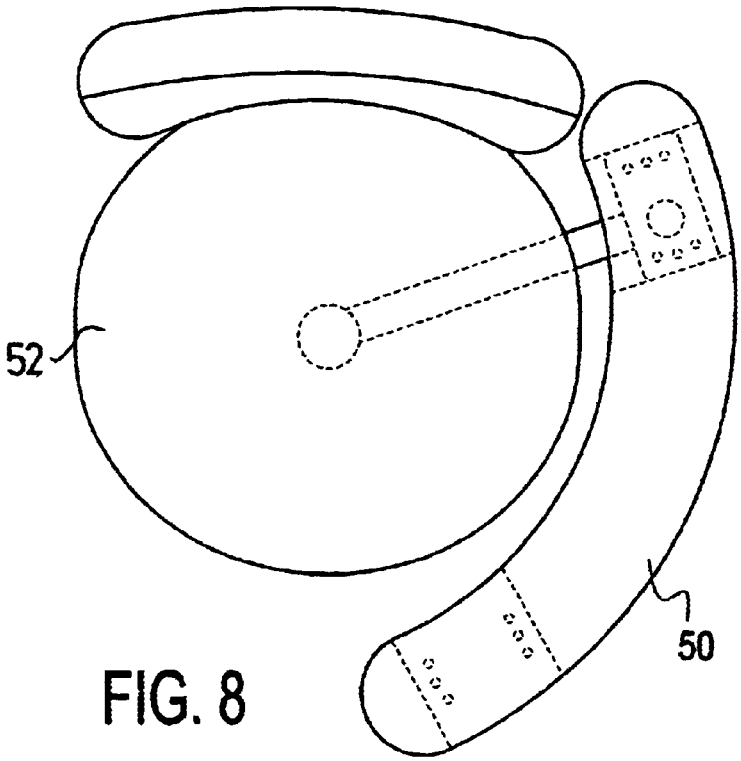
Figure 9:
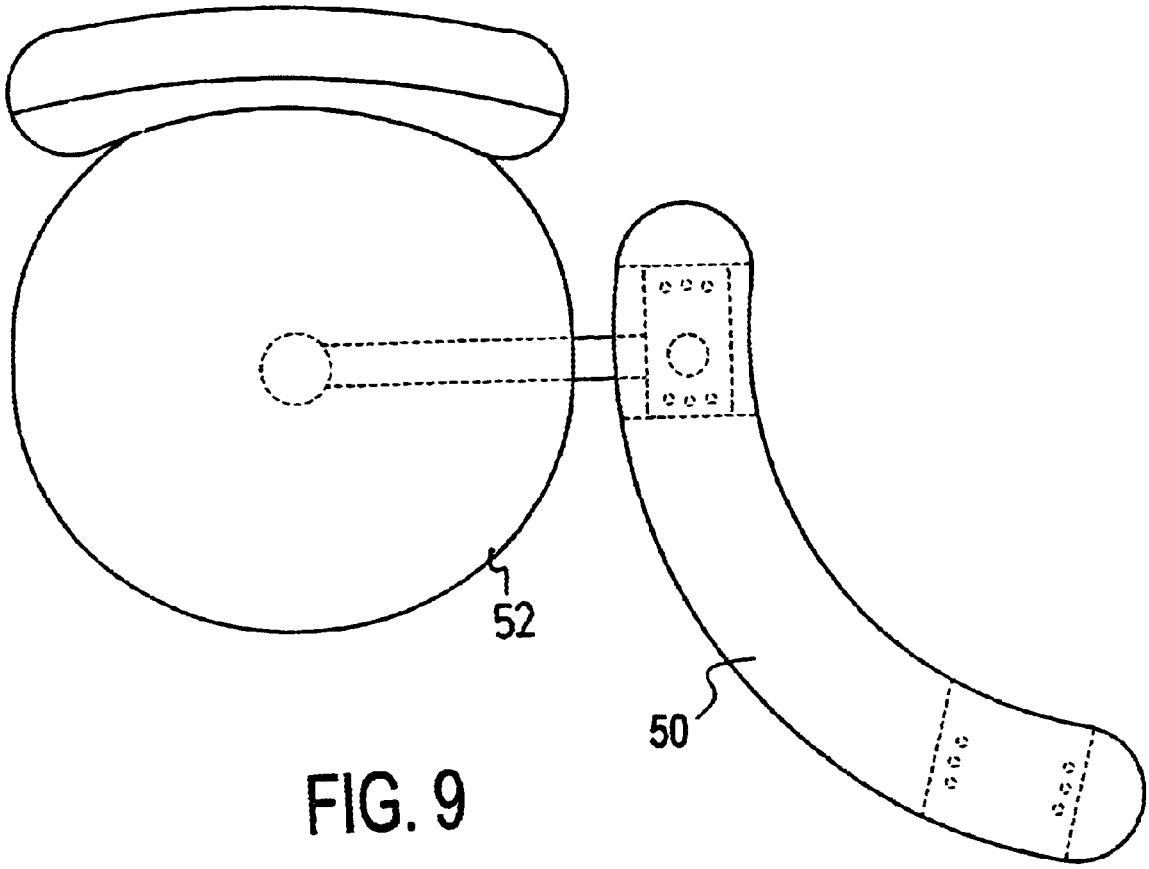
FIG. 9 is a schematic view showing that the controlling device is able to be relocated to different position on the support.

With reference to FIGS. 7 and 8, the support (50) is pivoted relative to the seat (52). FIG. 9 shows that the controlling device of the present invention is able to be relocated to another position of the support (50) to increase the variety of the stool's function.

A further application of the stool with the controlling device of the present invention is that the user is able to place a keyboard on the support (50) without the limitation of a conventional desk.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A controlling device for a support pivotally mounted on top of a stool having a base and a tube extending upward from the base and a seat rotatably mounted on top of the base, the controlling device comprising:

two pawls pivotally received in a housing;

the housing adapted to securely engage with a bottom face of the support and composed of a top cover, a body and a bottom cover; the bottom cover having two protruding posts respectively mounted on opposite sides of the bottom cover to correspond to the two pawls, and two positioning rods each being formed close to a corresponding one of the two protruding posts;

activating means for activating movement of either one of the pawls; and a ratchet gear received in the housing, whereby after either one of the pawls is activated, the activated pawl is able to selectively engage with the ratchet gear so that the support is able to pivot in a predetermined direction.

2. The controlling device as claimed in claim 1, wherein the activating means comprises a wedge pivotally received in the housing to control movement of the pawls.

3. The controlling device as claimed in claim 2, wherein the activating means further comprising a control knob pivotally mounted on the housing and opposite to the wedge.

4. The controlling device as claimed in claim 1, wherein each pawl has a first end, a hole and a spring having a first end securely connected to the first end of each pawl and a second end securely connected to a corresponding one of the two positioning rods so as to provide a recovery force to a corresponding pawl after a corresponding one of the two protruding posts extends into the hole of each pawl.

5. The controlling device as claimed in claim 4, wherein the activating means comprises a wedge pivotally received in the housing to control the movement of the pawls.

6. The controlling device as claimed in claim 5, wherein the activating means further comprising a control knob pivotally mounted outside the housing and opposite to the wedge, a linking rod is provided to connect the wedge to the control knob.

7. The controlling device as claimed in claim 6, wherein the ratchet gear is formed on top of an extension which is adapted to be received in the tube and has an indentation longitudinally defined in a periphery of the extension to receive therein a rectangular head, the rectangular head is formed with a threaded bolt which is extendable into the tube so that the rectangular head is received in the indentation and thus the extension is able to be adjustably moved relative to the tube.

* * * * *